US006131842A

United States Patent [19]

Schmodde

[11] Patent Number: 6,131,842

[45] Date of Patent: Oct. 17, 2000

[54] YARN FEEDER WITH IMPROVED YARN TRAVEL

[75] Inventor: Hermann Schmodde, Horb-Dettlingen, Germany

[73] Assignee: Memminger-IRO GmbH, Dornstetten, Germany

[21] Appl. No.: 09/268,406

[22] Filed: Mar. 15, 1999

[30] Foreign Application Priority Data

Mar. 14, 1998 [DE] Germany ..... 198 11 240

[51] Int. Cl.[7] ..... B65H 51/02

[52] U.S. Cl. ..... 242/365.7; 242/366

[58] Field of Search ..... 242/365.7, 365.6, 242/366, 366.1, 418.1

[56] References Cited

U.S. PATENT DOCUMENTS

| | | | |
|---|---|---|---|
| 4,136,837 | 1/1979 | Fecker et al. | 242/366 |
| 4,399,952 | 8/1983 | Schaub | 242/366 X |
| 4,660,783 | 4/1987 | Roser et al. | 242/366 X |
| 4,662,575 | 5/1987 | Fecker | 242/365.7 |
| 4,669,677 | 6/1987 | Roser et al. | 242/366.1 |
| 4,673,139 | 6/1987 | Memminger et al. | 242/366.1 |
| 4,706,476 | 11/1987 | Memminger et al. | 242/365.7 X |
| 4,752,044 | 6/1988 | Memminger et al. | 242/365.7 |
| 4,793,565 | 12/1988 | Fecker | 242/366 |
| 5,423,197 | 6/1995 | Roser | 242/365.7 X |
| 5,860,298 | 1/1999 | Chen | 242/365.6 X |

FOREIGN PATENT DOCUMENTS

| | | |
|---|---|---|
| 0 234 208A1 | 9/1987 | European Pat. Off. . |
| 3601586 | 5/1985 | Germany . |
| 3711558 C1 | 6/1988 | Germany . |
| 3820618 | 12/1989 | Germany . |
| 42 06 607A1 | 4/1993 | Germany . |
| 4206607 | 4/1993 | Germany . |
| 195 37 215 A1 | 4/1997 | Germany . |
| 19537215 | 4/1997 | Germany . |
| 2 169 927A | 7/1986 | United Kingdom . |

*Primary Examiner*—Christopher P. Ellis
*Assistant Examiner*—Collin A. Webb
*Attorney, Agent, or Firm*—Frishauf, Holtz, Goodman, Langer & Chick, P.C.

[57] ABSTRACT

A yarn feeder, which has a yarn feed wheel connected to an electric motor for positive feeding of a yarn as needed, has a yarn travel path which is defined by yarn eyelets at an angle to the pivot axis of the yarn feed wheel that is greater than the sum of 90° and an additional acute angle. This additional acute angle α is greater than the angle of inclination of a yarn lap on the yarn feed wheel in which adjacent windings contact one another. As a result, a smooth payout of the yarn on the yarn feed wheel is obtained.

21 Claims, 2 Drawing Sheets

YARN FEEDER WITH IMPROVED YARN TRAVEL

FIELD OF THE INVENTION

The invention relates to a yarn feeder for supplying yarns, especially elastic yarns, to yarn-using stations and, in particular, to an improved arrangement for supplying the yarn with a smooth payout from a yarn feed wheel.

BACKGROUND OF THE INVENTION

In the knitting industry, for instance, and in other fields of the textile industry as well, it is often necessary to supply knitting stations or other yarn-using stations with defined quantities of textile yarns. So-called positive feed mechanisms are used for this, which allocate the requisite yarn quantity to the respective yarn-using station and deliver it, regardless of the actual yarn takeup at the yarn using station. One such feed mechanism is known, for instance, from German Patent DE 3601586 C1. This feed mechanism is intended in particular for circular knitting machines, which have knitting stations with constant yarn consumption. The feed mechanism has a shaft, rotatably supported in a basic carrier, on one end of which a yarn feed drum is held in a manner fixed against relative rotation. The other end of the shaft is provided with a pulley that is in engagement with a toothed belt. This toothed belt is a driven belt which travels over the pulleys of many such yarn feeders that are thus driven at the same constant rpm.

The yarn feed drum has an outer circumference which is defined by many bars extending in the axial direction. The bars are held on their ends in terminal disks that are embodied substantially conically on their side toward the bars. The yarn to be fed wraps multiple times around the yarn feed drum, so that the drum draws the yarn from a bobbin and feeds it to the knitting station. From the yarn drum, the yarn is guided through eyelets which thus define a yarn travel path. The eyelet that follows the yarn feed drum is offset axially from the yarn feed drum so far that the yarn sweeps over the edge of the yarn feed drum. This aids in stripping off fluff from the edge of the drum and can be favorable to the takeup of additional yarn windings, if the yarn sags or begins to sag because there is no yarn takeup, or only slight yarn takeup, at the knitting station while feeding continues at a constant pace. The yarn then sags over the edge and continues to rest on the drum.

Yarn feeders of this type are highly suitable for applications involving substantially constant yarn consumption. However, applications also exist in which yarn consumption can be subject to very major fluctuations temporarily. This is the case, for instance, in flatbed knitting machines, in which a yarn guide, that delivers the yarn to the individual needles in succession, executes a reciprocating motion of the full width of the goods being produced. If the yarn feeder is disposed laterally, that is, if the yarn is fed crosswise to the width of the goods, the yarn consumption differs on the forward and return strokes. Furthermore, yarn consumption comes to a complete stop at the turning points of the yarn guide. In these cases, yarn feeders that feed yarn at a constant quantity over time certainly cannot be used. On the contrary, it is necessary that the fed yarn have a substantially constant tension, so that a constant mesh size will be obtained. To that end, a yarn feeder that has a motor-driven yarn feed wheel is known from German Patent Disclosure DE 19537215 A1. The yarn wraps several times around this wheel. After that, the yarn runs over a yarn tension sensor to the yarn-using station. The yarn tension sensor regulates the rpm of the motor of the yarn feed wheel via a closed control loop, so that the yarn tension is regulated to the set-point value.

The yarn feed wheel is formed by six vanes or wire brackets extending away from a central hub. The vanes or brackets each have two spaced-apart, parallel, radially extending legs, between which an axially oriented bearing portion is held. The bearing portion changes over into the radial spokes via radially outward-protruding portions bent into a U.

The payout direction of the yarn from the yarn feed wheel is, as for instance in German Patent Disclosure DE 4206607, defined at right angles to the pivot axis of the yarn feed wheel.

In the yarn feeder of DE 4206607 A1, a yarn feeder with intersecting bearing struts for the yarn is used. The yarn feed wheel thus has its smallest outside diameter in its center plane, so that a yarn delivered eccentrically slides onto this middle position. From there, it is drawn off via a yarn directing means, embodied here as a helical spring wound in the shape of a trumpet, in the center plane of the yarn feed wheel.

Such yarn feeders are intended for feeding elastic yarns. Such yarns include, for instance, Spandex™ yarns or other kinds of synthetic fibers. Because of their elasticity, it is critically important to monitor the yarn tension. It can also prove problematic that the often very thin (hair-fine) yarns have a tendency to wrap windings on top of one another or to form windings that stick together.

A repeatable and uniform separation over time of the quantities of yarn fed by the yarn feed wheel from windings located on the yarn feed wheel is especially difficult to achieve when rotary speeds are varying. However, a failure of the yarn to be released from the yarn feed wheel at high or otherwise critical rotary speeds so that it is, instead, entrained sticking together must be prevented, because that would lead to reverse feeding and thus cause the yarn to tear.

SUMMARY OF THE INVENTION

It is an object of the invention to create a yarn feeder that is capable of feeding yarns at varying yarn travel speeds with good reliability.

These and other objects are attained in accordance with one aspect of the invention by a yarn feeder having a motor-driven yarn feed wheel, which is rotatably supported about a fixedly set pivot axis. The yarn travel path is defined such that the yarn is paid out not precisely at a tangent to the yarn feed wheel but rather at an acute angle to the tangent. In other words, the yarn is paid out at an acute angle to a plane whose normal direction coincides with the pivot axis of the yarn feed wheel. The yarn being paid out thus travels away from the lap on the yarn feed wheel, which includes only a few windings. Because of the (usually low) tension of the yarn in the yarn travel path following the yarn feed wheel, it is separated from the yarn feed wheel.

Paying out the yarn obliquely, according to the invention, from the yarn feed wheel thus enables cleanly paying out yarn, surprisingly virtually entirely independently of the rotary speed, that is, at both low rpm and high rpm and in phases of abrupt acceleration and/or braking. The oblique position of the yarn feed wheel causes the individual windings in the yarn lap on the yarn feed wheel to be spaced apart from one another. The windings neither stick together nor rest on top of one another. While at high rpm, the resultant centrifugal forces acting on the yarn and radial air flows promote the loosening of the yarn from the yarn feed wheel so that the separation can be accomplished more easily, the oblique doffing promotes this process even at very low rpm or near a standstill of the yarn feed wheel. On the other hand, at high rpm, the separation from the yarn feed wheel of the yarn being paid out must be done very fast, because only a little time is available then for the purpose. Here as well, the oblique doffing promotes the yarn payout here as well. The tensile tension of the yarn generates an axial force component which penetrates more or less far into the lap past the payout point and causes the yarn to begin to slide axially before the payout point. The payout point may be spaced apart from the adjacent winding. It can thereby be attained that independently of the rpm, the angular location of the point at which the outgoing yarn separates from the yarn feed wheel remains constant. If the yarn feed wheel is followed immediately by a yarn tension sensor without any bearing portions, yarn eyelets or the like disposed in between, then this is of considerable significance for the constancy of the yarn tension. If the payout point were to shift forward or backward in the circumferential direction of the yarn feed wheel, the angular relationships of the yarn travelling over the yarn tension sensor would vary extremely, which would make correct detection of the yarn tension impossible. The constancy of the payout point that is made possible by the invention in turn, however, makes it possible to detect the yarn tension correctly with a yarn tension sensor, without having to provide additional yarn guide means.

With the invention, it therefore becomes possible to make do with a minimum of yarn directing means, such as eyelets, pegs or the like, in the yarn travel path that follows the yarn feed wheel. This is advantageous with respect to the friction acting on the yarn, which would otherwise distort the yarn tension.

In an advantageous embodiment, a first portion of the yarn travel path upstream of the yarn feed wheel is disposed parallel to the yarn travel path downstream of the yarn feed wheel, looking in the direction radially to the pivot axis of the yarn feed wheel. The pivot axis of the yarn feed wheel is thus oblique to the otherwise rectilinear yarn travel path. However, the first and second portions of the yarn travel path are offset from one another in the direction of the pivot axis of the yarn feed wheel by an amount that is preferably greater than the product of the yarn thickness and the number of windings. This promotes a sliding motion of the yarn on the feed wheel in the axial direction. This is brought about by the yarn wrapping onto the yarn feed wheel, which pushes the windings already present to the side. Because of the oblique position, the sliding motion can be improved especially just before the payout of the yarn, so that the last winding separates from the next-to-last winding without sticking to it. Under some circumstances, it is possible for the two windings to separate from one another already just before the point where the yarn lifts from the yarn feed wheel.

Another result attainable by the oblique position of the yarn feed wheel relative to the yarn travel path is that the guide means for the yarn that follows the yarn feed wheel guides the yarn solely in a transverse direction which by way of example is a circumferential direction with respect to the yarn feed wheel. This means that in a direction parallel to the pivot axis, the yarn can still be unguided. The actual payout point, because of the oblique position of the yarn feed wheel relative to the arriving yarn, is automatically established in accordance with the thus-defined inclination, which is greater than an inclination that would be defined by a lap in which the windings are on top of one another. In terms of the axial direction of the yarn feed wheel, the yarn is guided freely; that is, there is no guidance.

The yarn directing device that follows the yarn feed wheel can simultaneously be embodied as a yarn tension sensor. The yarn passes over the sensor (peg) at an obtuse angle of preferably more than 130°. The slight deflection of the peg keeps the friction low. Because of the constancy of the payout point from the yarn feed wheel, this angle can be kept largely constant, which enables and assures replicable measurement results.

Yarn guide eyelets at the inlet and outlet of the yarn feeder assure that factors located outside the yarn feeder, such as the positioning of the yarn bobbins or other yarn directing means, will have no influence on conditions at the yarn feed wheel.

The yarn feed wheel is preferably a lightweight model with only a few radial arms, so that it can be accelerated and stopped quickly, which purpose is served by the suitably regulated or controlled motor. To that end, the radial arms are embodied as wire brackets, for instance, which define a polygonal yarn engagement face on the outer circumference of the yarn feed wheel. The corresponding radial arm portions are oriented substantially axially or at a small acute angle to pivot axis, making the engagement face somewhat conical.

The individual radial arms may be disposed on a hub at equal angular spacings. However, the angular spacings can also vary somewhat, to prevent the inducement of intrinsic vibration of the yarn on passing through various rotary speeds.

DETAILED DESCRIPTION OF THE INVENTION

Figure 1:
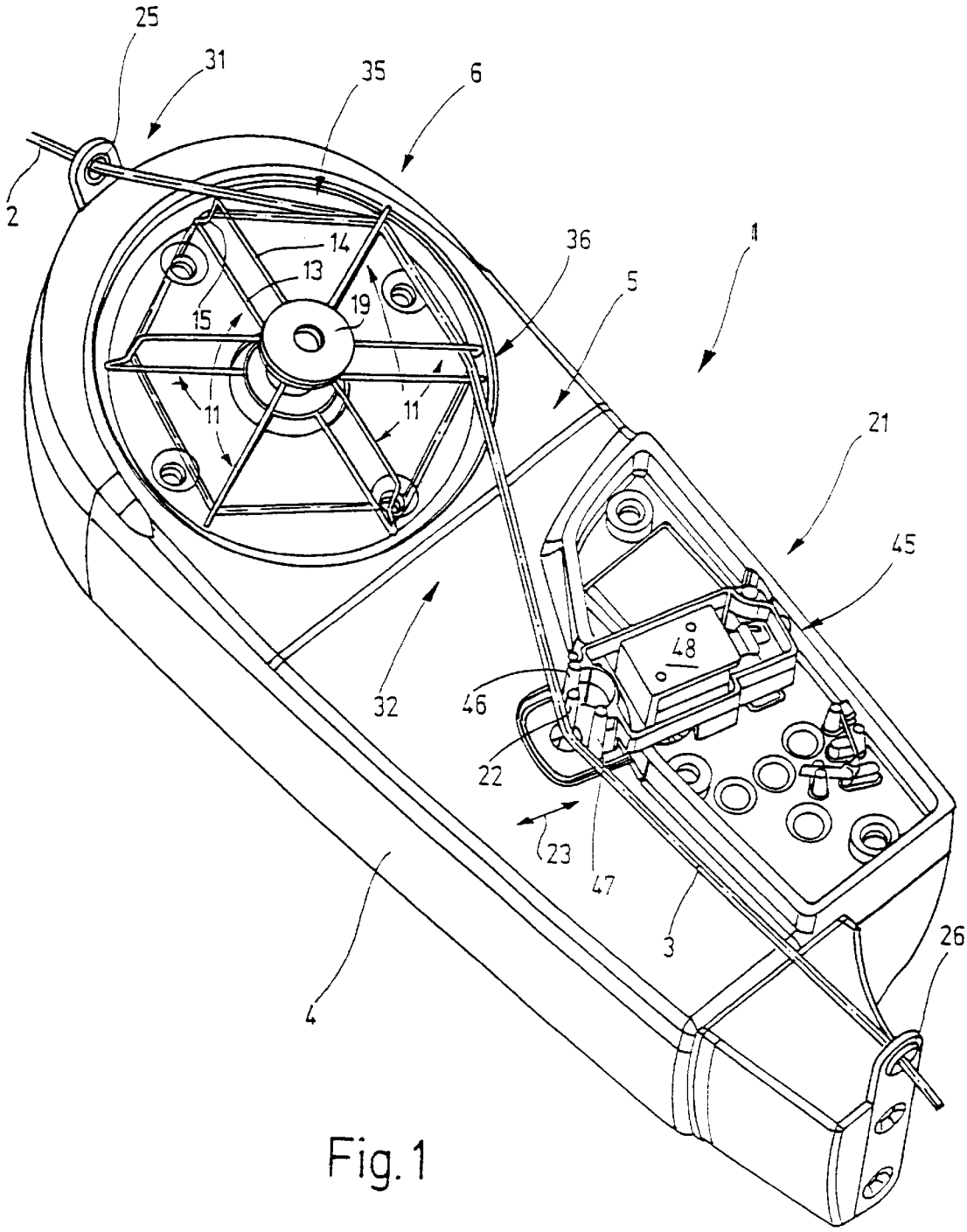
FIG. 1 shows a yarn feeder in a schematic perspective view.

In FIG. 1, a yarn feeder 1 is shown of the kind that can be used, for instance, to feed Spandex™ yarns to flatbed knitting machines or other kinds of yarns to yarn-using stations of other machines. The yarn feeder 1 is used to draw off a yarn 2 from a yarn source, such as a bobbin (not shown), and feed it along a yarn travel path 3 to the yarn-using station (not shown). This yarn feeding should be done to the extent possible in an amount suiting the requirement or at a constant yarn tension.

Figure 2:
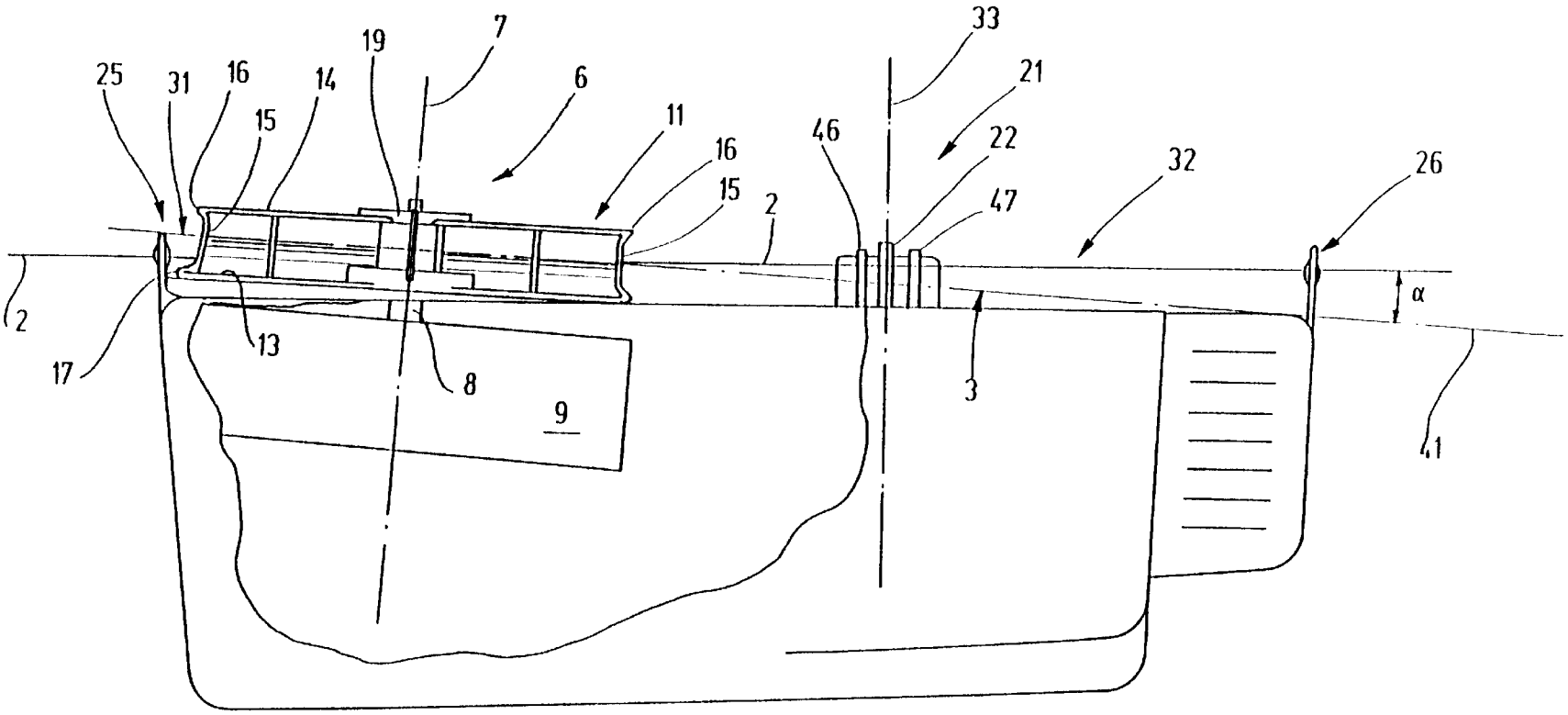
FIG. 2 shows the yarn feeder of FIG. 1 in a simplified side view illustrating yarn guidance at the yarn feed wheel.

The yarn feeder 1 has a housing 4, on the substantially flat front side 5 of which a yarn feed wheel 6 is disposed that serves to feed the yarn 2 as needed. As shown in FIG. 2, the yarn feed wheel 6 is rotatably supported about a pivot axis 7. To that end, it is secured to a drive shaft 8 of an electric motor 9, preferably embodied as a disk rotor motor, which is disposed stationary in the interior of the housing 4. The yarn feed wheel 6 is constructed to be lightweight. Vanes or arms 11 extend radially outward from its hub 19 and are formed by wire brackets. These elements are embodied identically to one another. Each arm 11 has two radial spoke portions 13, 14, extending radially away from the hub 19 and spaced apart from and parallel to one another, which are joined together on the outer periphery of the yarn feed wheel 6 by a bearing strut 15. As shown in FIG. 2, the bearing struts 15 are substantially straight wire segments that are oriented at an acute angle to the pivot axis 7. At both ends, with a radial protrusion 16, 17, they change over into the radial spoke portions 13, 14.

In the present exemplary embodiment, six arms 11 are provided, which are disposed at equal angular spacings of 60°. However, different angles can also be selected, to prevent inducing vibration of the yarn 2.

The disk rotor motor 9 and the yarn feed wheel 6 belong to a closed control loop for regulating yarn feeding as a function of the tension of the yarn 2. The yarn tension is detected with a sensor 21, which is disposed on the front side 5 of the housing 4 of the yarn feeder 1, following the yarn feed wheel 6. The yarn tension sensor 21 has a bearing peg 22, which is connected to a force sensor. This sensor detects the slightest motions of the peg 22 in the transverse direction that are dependent on the yarn tension. This direction is represented in FIG. 1 by an arrow 23. No further yarn guide or directing means are preferably provided between the yarn feed wheel 6 and the bearing peg 22 of the yarn tension sensor 21.

Besides the yarn feed wheel 6 and the bearing peg 22 of the yarn tension sensor 21, a yarn inlet eyelet 25 disposed upstream of the yarn feed wheel 6 and a yarn outlet eyelet 26 following the yarn tension sensor 21 also serve to define the yarn travel path 3. They are disposed such that they define a first portion 31 of the yarn travel path 3 upstream of the yarn feed wheel and a second portion 32 of the yarn travel path 3 downstream of the yarn feed wheel 6 that are parallel to and offset from one another, as seen in FIG. 2. This three-dimensional location of the first and second portions 31, 32 of the yarn travel path 3 is the result of the position of the yarn inlet eyelet 25 and the yarn outlet eyelet 26, in conjunction with an oblique position of the yarn feed wheel 6 and optionally a corresponding orientation of the bearing peg, or its longitudinal center axis 33. Once the yarn 2 has passed through the yarn inlet eyelet 25 and the first yarn travel path portion 31, it touches the yarn feed wheel 6 for the first time at a bearing point 35. From there onward, it is guided in at least one winding around the yarn feed wheel until a payout point 36, which is axially offset from the contact point 35 relative to the pivot axis 7 of the yarn feed wheel 6.

The axial offset between these two points 35, 36 that results from the positioning of the yarn inlet eyelet 25 and the yarn outlet eyelet 26 relative to the yarn feed wheel 6 is greater than the inclination of the windings on the yarn feed wheel 6, which is determined by the thickness of the yarn 2, so that the yarn 2 being paid out does not touch windings resting on the yarn feed wheel 6. With respect to a center plane 41 of the yarn feed wheel 6, suggested in dot-dashed lines in FIG. 2, on which the pivot axis 7 stands perpendicularly, this is achieved by disposing the yarn inlet eyelet 25 below this center plane 41 and the yarn outlet eyelet 26 above this plane. With respect to the yarn 2, this means that the first yarn travel path portion 31, seen from the side (FIG. 2), is offset parallel from the second yarn travel path portion 32; the parallel offset is greater than the number of windings present on the yarn feed wheel 6, multiplied by the yarn thickness. The result is accordingly an acute angle between the yarn travel path 3 and the center plane 41, amounting preferably to a few degrees.

With respect to the longitudinal direction 33 of the bearing peg 22, the inlet eyelet 25 and the outlet eyelet 26 are at virtually the same height, however. This creates a parallel offset between the arriving and departing yarn. In the final analysis, this offset is attained by the oblique position of the pivot axis 7. With a view to an angle of inclination of an imaginary yarn lap on the yarn feed wheel 6 whose windings rest on one another, this oblique position is greater than the resultant angle of inclination. This means that the angle $\alpha$ between the longitudinal center plane 41 and an imaginary connecting line between the inlet eyelet 25 and the outlet eyelet 26 is greater than the angle of inclination of a lap with windings resting on one another. The angle $\alpha$ is preferably greater than twice the angle of inclination. The result is spacings between the windings of the lap that assure the payout of the yarn under all conditions.

The yarn feeder 1 also has a calibration device 45 for the yarn tension sensor 21. The calibration device 45 includes two yarn bearing pegs 46, 47, which in normal operation of the yarn feeder 1 are lifted away from the yarn 2, or in other words are not in engagement with it. At certain time intervals, the yarn bearing pegs 46, 47 can be adjusted in the direction of the arrow 23 by actuations of a tension magnet 48 in such a way that they lift the yarn 2 from the peg 22 of the yarn tension sensor 21. This is used for finding the zero point. As needed and/or as a substitute, the yarn tension sensor 21 can also be moved for the purpose of calibration.

The yarn feeder described thus far functions as follows:

In operation, the yarn tension sensor 21 detects the existing tension of the yarn 2 in accordance with the lateral deflection of the peg 22, although this is slight and is within the range of 1 mm. The yarn consumption at a yarn-using station downstream of the yarn feeder 1, such as the knitting station of a knitting machine, is expressed in the yarn tension, which is regulated to be constant by a closed control loop. To that end, the motor 9 is energized such that the yarn feed wheel 6 furnishes the required yarn quantity to keep the yarn tension constant. If the tension rises, the motor 9 speed is increased until the yarn tension has resumed its set-point value. If the yarn tension drops, the yarn feed wheel is slowed down (if necessary to a standstill) until the desired yarn tension has been re-established.

Regardless of the rpm of the yarn feed wheel 6, the arriving yarn 2 runs up onto the outer circumference of the yarn feed wheel 6 in the vicinity of its radial protrusion 17 or on an oblique portion of the respective radial protrusion 17. All the oblique portions define a conical face. The yarn 2 wraps around the yarn feed wheel one or a few times (from three to five times) with an inclination that is approximately equivalent to its thickness. The yarn 2 then runs away in the vicinity of the center plane 41 or above it without touching the radial protrusions 16. Thus the edges of the yarn feed wheel defined by the radial protrusions 16, 17 are not touched even though the yarn 2 arrives and leaves obliquely relative to the yarn feed wheel 6. Because of the oblique position of the axis of the yarn feed wheel by an angle that is greater than the angle of inclination of the lap, an axial force component results at the payout point from the yarn tension as a consequence of the oblique travel of the yarn toward the center plane 41. As a result, the yarn 2 being paid out does not stick to the yarn feed wheel or to adjacent windings in response to either mechanical or electrostatic or other kinds of effects. The result is a smooth, uniform payout of the yarn 2. In the ideal case, a plurality of windings or all of them may also be spaced apart from one another.

A yarn feeder 1, which has a yarn feed wheel 6 connected to an electric motor 9 for positive feeding of a yarn 2 as needed, has a yarn travel path 3 which is defined by yarn eyelets 25, 26 at an angle to the pivot axis 7 of the yarn feed wheel 6 that is greater than the sum of 90° and an additional acute angle. This additional acute angle $\alpha$ is greater than the angle of inclination of a yarn lap on the yarn feed wheel 6 in which adjacent windings contact one another. As a result, a smooth payout of the yarn 2 on the yarn feed wheel 6 is obtained.

What is claimed is:

1. A yarn feeder for supplying yarn to a yarn-using station, comprising:

a yarn feed wheel (6) rotatably supported about a pivot axis (7) and disposed in a yarn travel path (3), so that the yarn (2) can wrap around the yarn feed wheel; and a motor (9) coupled to the yarn feed wheel to drive the wheel, thereby feeding the yarn (2);

wherein the yarn travel path (3), downstream of the yarn feed wheel (6), is arranged at an acute angle ($\alpha$) other than zero relative to a plane (41), the pivot axis (7) being perpendicular to said plane, wherein the yarn travel path (3) has a first position (31), leading toward the yarn feed wheel (6), and a second portion (32), leading away from the yarn feed wheel (6), and that the first portion (31) is disposed in a plane that is parallel to a plane containing the second portion (32), and wherein a spacing between the planes is greater than a product of the maximum yarn thickness and a number of windings with which the yarn (2) wraps around the yarn feed wheel (6).

2. The yarn feeder of claim 1, wherein the motor (9) carries the yarn feed wheel (6), and the motor has a pivot axis that coincides with the pivot axis (7) of the yarn feed wheel (6).

3. The yarn feeder of claim 1, wherein the yarn travel path (3) of the yarn feeder (1), through which among others the yarn (2) runs when it is fed from a yarn source to a yarn using station, is defined by a yarn guide means (25, 6, 22, 26), and wherein the yarn guide means (25, 6, 22, 26) include at least the yarn feed wheel (6) and a directing device (22), disposed downstream of the yarn feed wheel (6), that guides the yarn (2) being paid out from the yarn feed wheel (6) without touching an edge of the yarn feed wheel.

4. The yarn feeder of claim 3, wherein the directing device (22) guides the yarn (2) solely in a first transverse direction (23), the directing device (22) comprising a peg (22) over which the yarn (2) moves freely movably in the transverse direction (23) of the peg, and the yarn (2) contacts the directing device (22) at an obtuse angle that is greater than 130°.

5. The yarn feeder of claim 4, wherein the directing device (22) is connected to the yarn tension sensor (21) for detecting the yarn tension.

6. The yarn feeder of claim 5, wherein the directing device (22) is supported substantially immovably.

7. The yarn feeder of claim 4, wherein the peg (22) has a longitudinal axis (33) which forms an acute angle with the pivot axis (7).

8. The yarn feeder of claim 7, wherein the acute angle is less than 10°.

9. The yarn feeder of claim 4, wherein the yarn guide means (25, 6, 22, 26) further comprises a guide device (26) disposed downstream of the directing device (22).

10. The yarn feeder of claim 9, wherein the guide device (26) is an eyelet which guides the yarn (2) at least in a second transverse direction.

11. The yarn feeder of claim 9, wherein the guide device (26) and a portion (32) of the yarn travel path between the yarn feed wheel (6) and the guide device are disposed in a plane that intersects the yarn feed wheel (6) over its entire circumference.

12. The yarn feeder of claim 10, wherein the guide device (26) and the portion (32) of the yarn travel path between the yarn feed wheel (6) and the guide device are disposed in a plane that intersects the yarn feed wheel (6) over its entire circumference.

13. The yarn feeder of claim 1, wherein the acute angle ($\alpha$) is larger than an angle of inclination that results in a yarn lap with windings disposed without spacing on the yarn feed wheel (6).

14. The yarn feeder of claim 13, wherein the acute angle is preferably more than twice as large as the angle of inclination.

15. The yarn feeder of claim 1, wherein the motor (9) is a low-inertia motor.

16. The yarn feeder of claim 1, wherein the yarn feed wheel (6) has a plurality of radial arms (11), substantially identically to one another, which are disposed at preferably equal angular spacings from one another.

17. The yarn feeder of claim 16, wherein the radial arms (11) are disposed at different angular spacings.

18. The yarn feeder of claim 16, wherein the radial arms (11) are formed by wire brackets, each having two radial spoke portions (13, 14) which are joined together by a substantially axial bearing portion (15).

19. The yarn feeder of claim 18, wherein a radial protrusion (16, 17) is at the transition between the axial portion (15) and the radial spoke portion (13, 14).

20. The yarn feeder of claim 1, wherein preceding the yarn feed wheel (6) in the yarn travel path (3) is a guide device (25) which is disposed, together with a portion (31) of the yarn travel path (3) between the yarn feed wheel (6) and the guide device (25), in a plane that intersects the yarn feed wheel (6) over its entire circumference.

21. The yarn feeder of claim 1 wherein the motor is a disk rotor motor.

* * * * *